US008841527B2

(12) United States Patent
Shih et al.

(10) Patent No.: US 8,841,527 B2
(45) Date of Patent: Sep. 23, 2014

(54) ELECTRIC DRUM AND CYMBAL WITH SPIDER WEB-LIKE SENSOR

(75) Inventors: Ming-Shan Shih, New Taipei (TW); Hsien-Tang Wang, New Taipei (TW); Gwo-Hsiung Wei, New Taipei (TW)

(73) Assignee: Al-Musics Technology Inc., New Taipei (TW)

( * ) Notice: Subject to any disclaimer, the term of this patent is extended or adjusted under 35 U.S.C. 154(b) by 167 days.

(21) Appl. No.: 13/612,508

(22) Filed: Sep. 12, 2012

(65) Prior Publication Data

US 2014/0069265 A1 Mar. 13, 2014

(51) Int. Cl.
*G10F 1/08* (2006.01)

(52) U.S. Cl.
USPC ..... 84/104; 84/113; 84/723; 84/735

(58) Field of Classification Search
CPC ..... G10D 13/02; G10D 13/06; G10H 3/12; G10H 1/32; G10H 7/00; G10H 3/00; G10H 1/44; G10H 1/00; G10G 7/02; G10C 3/06; G10C 1/00; G10K 11/00; G06F 17/00
See application file for complete search history.

(56) References Cited

U.S. PATENT DOCUMENTS

| | | | | |
|---|---|---|---|---|
| 5,396,024 | A * | 3/1995 | Noguchi et al. | 84/730 |
| 5,585,581 | A * | 12/1996 | Rogers | 84/414 |
| 7,038,117 | B2 * | 5/2006 | Yoshino | 84/411 R |
| 7,396,991 | B2 * | 7/2008 | Susami | 84/615 |
| 8,563,843 | B1 * | 10/2013 | Shemesh | 84/743 |
| 2004/0118269 | A1 * | 6/2004 | Yoshino | 84/723 |
| 2005/0022655 | A1 * | 2/2005 | Wise | 84/743 |
| 2005/0150366 | A1 * | 7/2005 | Susami | 84/735 |
| 2007/0131090 | A1 * | 6/2007 | Stannard | 84/422.4 |
| 2007/0234886 | A1 * | 10/2007 | Matsuyuki et al. | 84/723 |
| 2009/0000464 | A1 * | 1/2009 | Mishima | 84/724 |
| 2010/0083812 | A1 * | 4/2010 | Peavey | 84/411 R |

FOREIGN PATENT DOCUMENTS

| | | | | |
|---|---|---|---|---|
| EP | 1837860 | A2 * | 9/2007 | G10H 3/14 |

* cited by examiner

*Primary Examiner* — Marlon Fletcher
(74) *Attorney, Agent, or Firm* — Han IP Corporation

(57) ABSTRACT

An electronic percussion instrument may include a percussion member that generates vibrations when percussed, a vibration resonance member, a vibration damping member, and an electronic sound generation unit. The vibration resonance member may include a hub portion, a plurality of radial portions extending radially from the hub portion, and a plurality of spiral portions. Each of the spiral portions may be disposed between and connects respective two of the radial portions. Each of the radial portions may be connected to a respective adjacent one of the radial portions by one or more of the spiral portions. The vibration damping member, disposed between the percussion member and the vibration resonance member, may propagate the vibrations generated by the percussion member to the vibration resonance member. The electronic sound generation unit, connected to the vibration resonance member, may sense the vibrations through the vibration resonance member and generate an electronic percussion sound.

20 Claims, 11 Drawing Sheets

ELECTRIC DRUM AND CYMBAL WITH SPIDER WEB-LIKE SENSOR

BACKGROUND

1. Technical Field

The present disclosure relates to the field of electronic musical instruments and, more particularly, to electronic percussion instruments.

2. Description of the Related Art

There are various types of electronic musical instruments, including electronic percussion instruments. Electronic drums, also known as digital drums, are a common type of electronic percussion instruments and are typically categorized as drum pads and cymbals. In general, a drum pad is comprised of either a rubber pad or a mesh-type pad.

In a conventional drum pad with a rubber pad, a thin metallic plate is adhered to the rubber pad with a piezoelectric sensor disposed in or near the center of the metallic plate. In a conventional cymbal, the piezoelectric sensor is directly disposed on the rubber pad. FIG. 12 is a diagram of a conventional electronic drum pad and FIG. 13 is a diagram of a conventional electronic cymbal. As shown in FIG. 12 and FIG. 13, the range of signal detection of the piezoelectric sensor is small, especially when compared to the size of the percussion area of the drum pad and cymbal. This may not be a significant issue if and when the size of the percussion area of the drum pad or cymbal is also small. However, an electronic drum pad or cymbal in a 1:1 scale relative to a non-electronic drum or cymbal has a relatively larger percussion area and, consequently, sensitivity of the piezoelectric sensor with respect to percussions on the peripheral region of the percussion area may be diminished. Further, vibrations caused by percussions on the percussion area as sensed by the piezoelectric sensor and a signal generated by the piezoelectric sensor for generation of an electronic percussion sound may be unstable. An electronic sound thus generated tends to be less than ideal.

SUMMARY

The present disclosure provides various embodiments of an electronic percussion instrument, such as an electronic drum or an electronic cymbal. Compared with existing electronic percussion instruments, an electronic percussion instrument according to the present disclosure produces signals with improved stability for electronic sound generation. Additionally, an electronic percussion instrument according to the present disclosure offers an increased range of signal detection with respect to the size of percussion area.

In one aspect, an electronic percussion instrument may comprise a percussion member that generates vibrations when percussed, a vibration resonance member, a vibration damping member, and an electronic sound generation unit. The vibration resonance member may comprise a hub portion, a plurality of radial portions extending radially from the hub portion, and a plurality of spiral portions. Each of the spiral portions may be disposed between and connects respective two of the radial portions. Each of the radial portions may be connected to a respective adjacent one of the radial portions by one or more of the spiral portions. The vibration damping member, disposed between the percussion member and the vibration resonance member, may propagate the vibrations generated by the percussion member to the vibration resonance member. The electronic sound generation unit, connected to the vibration resonance member, may sense the vibrations through the vibration resonance member and output a signal used in generation of an electronic percussion sound.

In at least some embodiments, a shape of the vibration resonance member may generally resemble a spider web.

In at least some embodiments, a profile of a primary surface of the vibration resonance member that faces the percussion member may be generally polygonal-shaped.

In at least some embodiments, a profile of a primary surface of the vibration resonance member that faces the percussion member may be generally fan-shaped.

In at least some embodiments, a profile of a primary surface of the vibration resonance member that faces the percussion member may be generally round-shaped.

In at least some embodiments, a thickness of the vibration resonance member may be between 0.3 mm and 5.0 mm approximately.

In at least some embodiments, a contour of a primary surface of the vibration resonance member that faces the percussion member may be shaped to approximately match a contour of a portion of a primary surface of the percussion member that faces the vibration resonance member.

In at least some embodiments, the vibration resonance member may comprise a plastic material.

In at least some embodiments, the vibration resonance member may comprise a metallic material.

In at least some embodiments, the vibration damping member may comprise a plurality of damping pads, and at least some of the damping pads may be disposed between the percussion member and at least some of the spiral portions of the vibration resonance member.

In at least some embodiments, the vibration damping member may comprise a plurality of damping pads, and at least some of the damping pads may be disposed between the percussion member and at least some of the radial portions of the vibration resonance member.

In at least some embodiments, the vibration damping member may comprise a foam material.

In at least some embodiments, the vibration damping member may comprise a silicon-based material.

In at least some embodiments, the electronic sound generation unit may comprise a sensor and a circuit coupled to the sensor. The sensor may sense the vibrations and generate an electronic signal based on the vibrations. The circuit may receive the electronic signal and generate the electronic percussion sound.

In at least some embodiments, the sensor may comprise a piezoelectric sensor.

In at least some embodiments, the sensor may be at least partially disposed on the hub portion of the vibration resonance member and on a surface of the hub portion that faces the percussion member.

In at least some embodiments, the sensor may be at least partially disposed on the hub portion of the vibration resonance member and on a surface of the hub portion that faces away from the percussion member.

In at least some embodiments, the percussion member may comprise a metallic plate.

In at least some embodiments, the percussion member may further comprise a rubber pad, and the metallic plate may be disposed between the rubber pad and the vibration resonance member.

In at least some embodiments, the electronic percussion instrument may further comprise a hoop and a holder. The percussion member, the vibration resonance member, the vibration damping member, and at least a portion of the electronic sound generation unit may be disposed between the hoop and the holder.

This summary is provided to introduce concepts relating to an electronic percussion instrument with a spider web-like sensor. Some embodiments of the electronic percussion instrument are further described below in the detailed description. This summary is not intended to identify essential features of the claimed subject matter, nor is it intended for use in determining the scope of the claimed subject matter.

BRIEF DESCRIPTION OF THE DRAWINGS

The accompanying drawings are included to provide a further understanding of the disclosure, and are incorporated in and constitute a part of the present disclosure. The drawings illustrate embodiments of the disclosure and, together with the description, serve to explain the principles of the disclosure. It is appreciable that the drawings are not necessarily in scale as some components may be shown to be out of proportion than the size in actual implementation in order to clearly illustrate the concept of the present disclosure.

DETAILED DESCRIPTION OF PREFERRED EMBODIMENTS

Overview

An electronic percussion instrument according to the present disclosure utilizes a novel vibration resonance member. The vibration resonance member senses resonates in response to sensing, via a resonance damping member, vibrations generated by a percussion member of the electronic percussion instrument when the percussion member is beaten, struck or otherwise percussed by a user. The vibration resonance member comprises a hub portion, a plurality of radial portions extending radially from the hub portion, and a plurality of spiral portions. Each of the spiral portions is disposed between and connects respective two of the radial portions. Each of the radial portions is connected to a respective adjacent one of the radial portions by one or more of the spiral portions. Accordingly, the vibration resonance member has a configuration that generally resembles a spider web, and acts as an effective sensor of vibration with its spider-web like configuration. The profile of the vibration resonance member may be adopted to fit the particular shape and size of the percussion member, e.g., a metallic plate or a combination of a metallic plate and a rubber pad, of the electronic percussion instrument. The resultant range of signal detection of a piezoelectric sensor of the electronic percussion instrument of the present disclosure is thus relatively large, i.e., covering most of the area of the percussion member, and the signal for generation of an electronic percussion sound is stable.

Exemplary Embodiments

Figure 5:
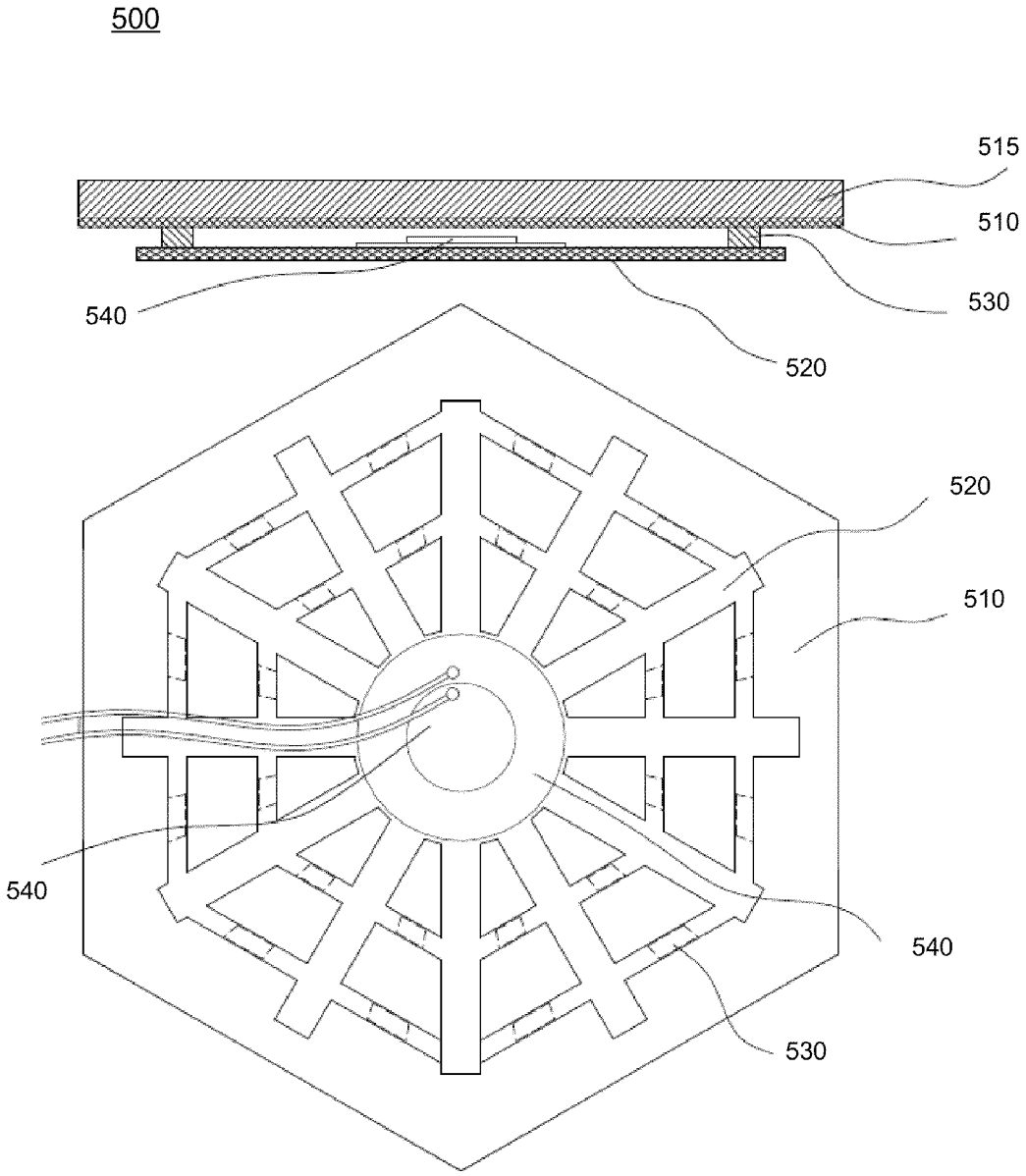
FIG. 5 is a top view of a vibration resonance member of an electronic percussion instrument in accordance with another embodiment of the present disclosure.
Figure 6:
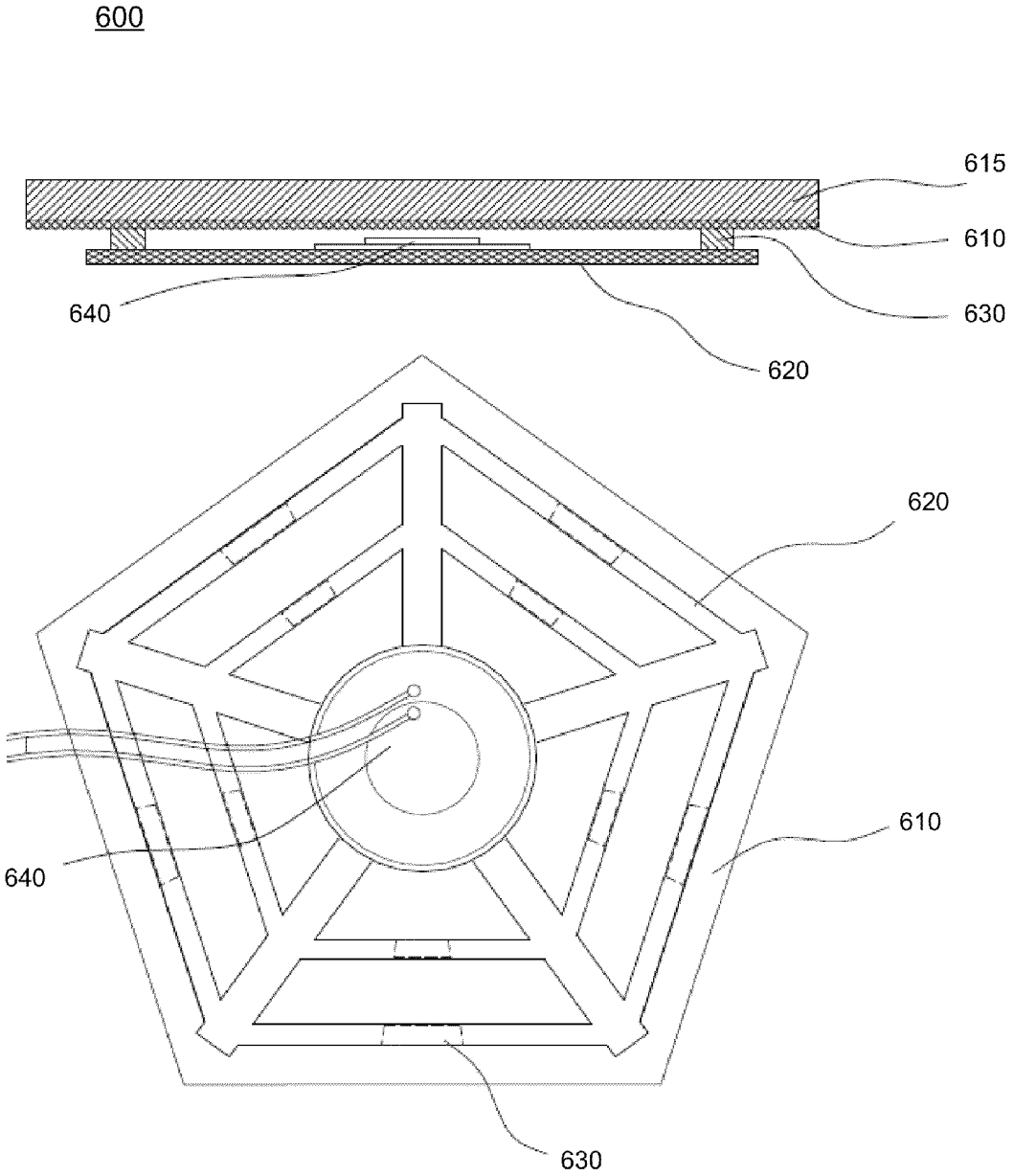
FIG. 6 is a top view of a vibration resonance member of an electronic percussion instrument in accordance with yet another embodiment of the present disclosure.
Figure 7:
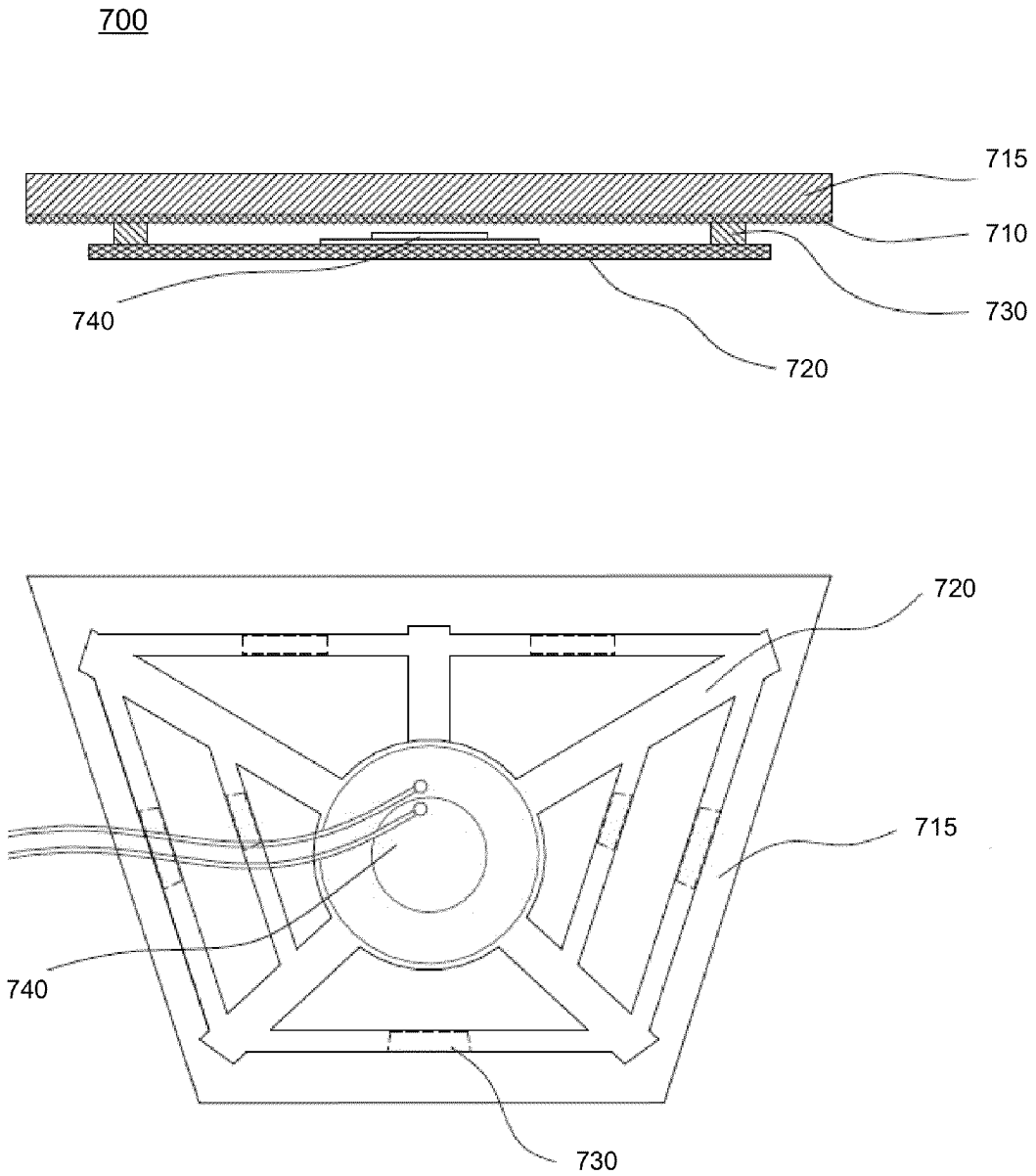
FIG. 7 is a top view of a vibration resonance member of an electronic percussion instrument in accordance with still another embodiment of the present disclosure.

FIGS. 1-4 illustrate various views of an electronic percussion instrument 100 in accordance with an embodiment of the present disclosure. FIGS. 5-7 illustrate a top view of various embodiments of a vibration resonance member of an electronic percussion instrument in accordance with another embodiment of the present disclosure. As shown in FIGS. 1-4, the electronic percussion instrument 100 comprises a percussion member 110, a vibration resonance member 120, a vibration damping member 130, and an electronic sound generation unit 140.

Figure 1:
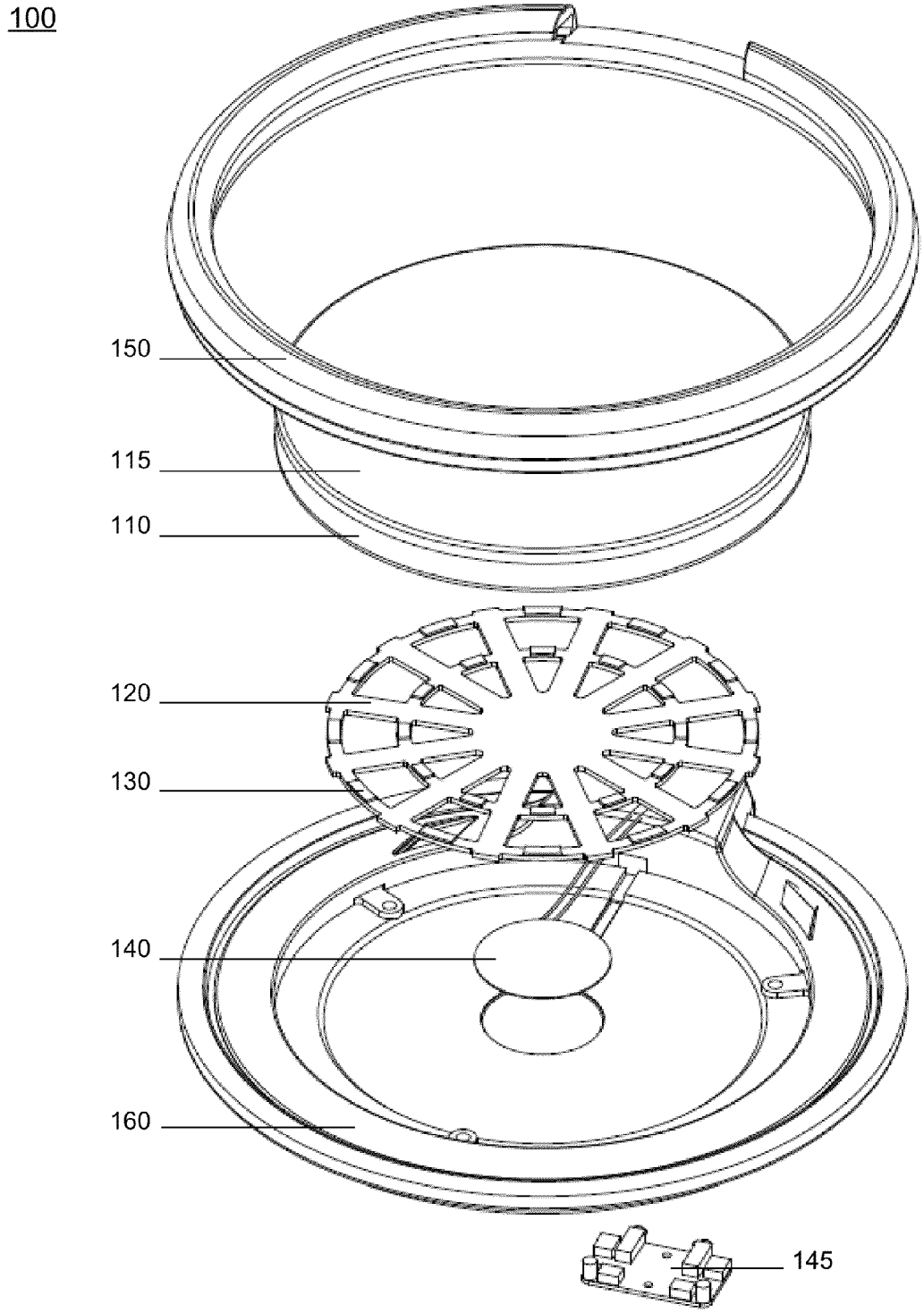
FIG. 1 is an exploded view of an assembly of an electronic percussion instrument in accordance with an embodiment of the present disclosure.
Figure 2:
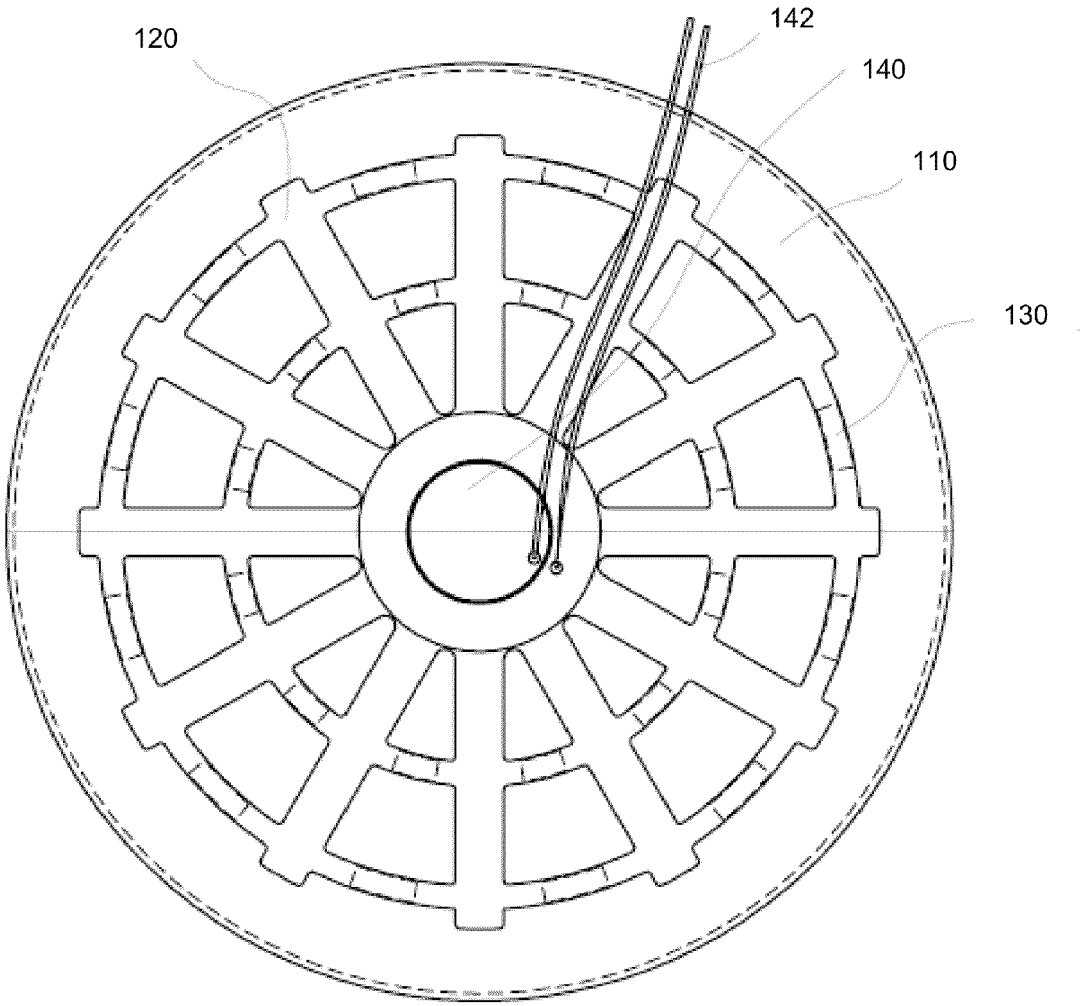
FIG. 2 is a bottom view of a vibration resonance member of the electronic percussion instrument of FIG. 1.
Figure 3:
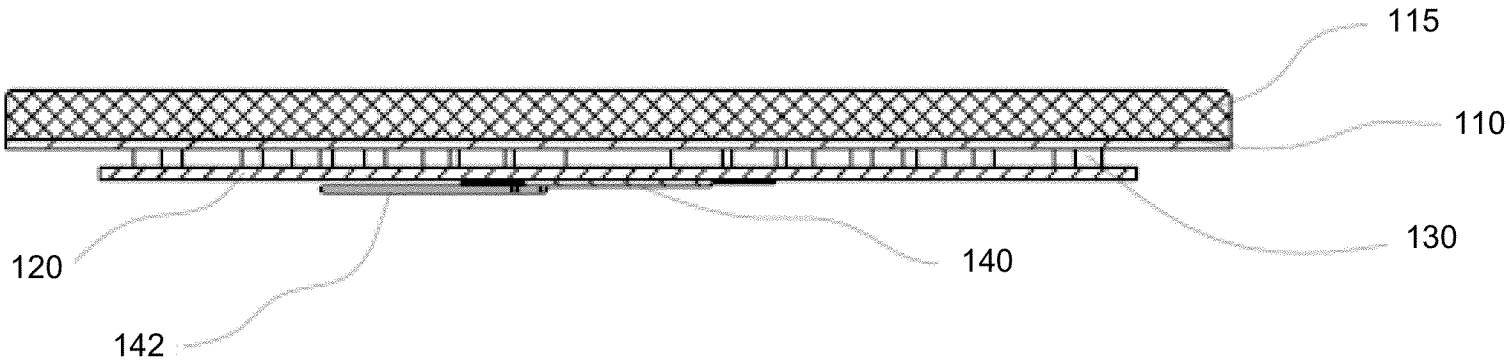
FIG. 3 is a side view of a vibration resonance member of the electronic percussion instrument of FIG. 1.
Figure 4:
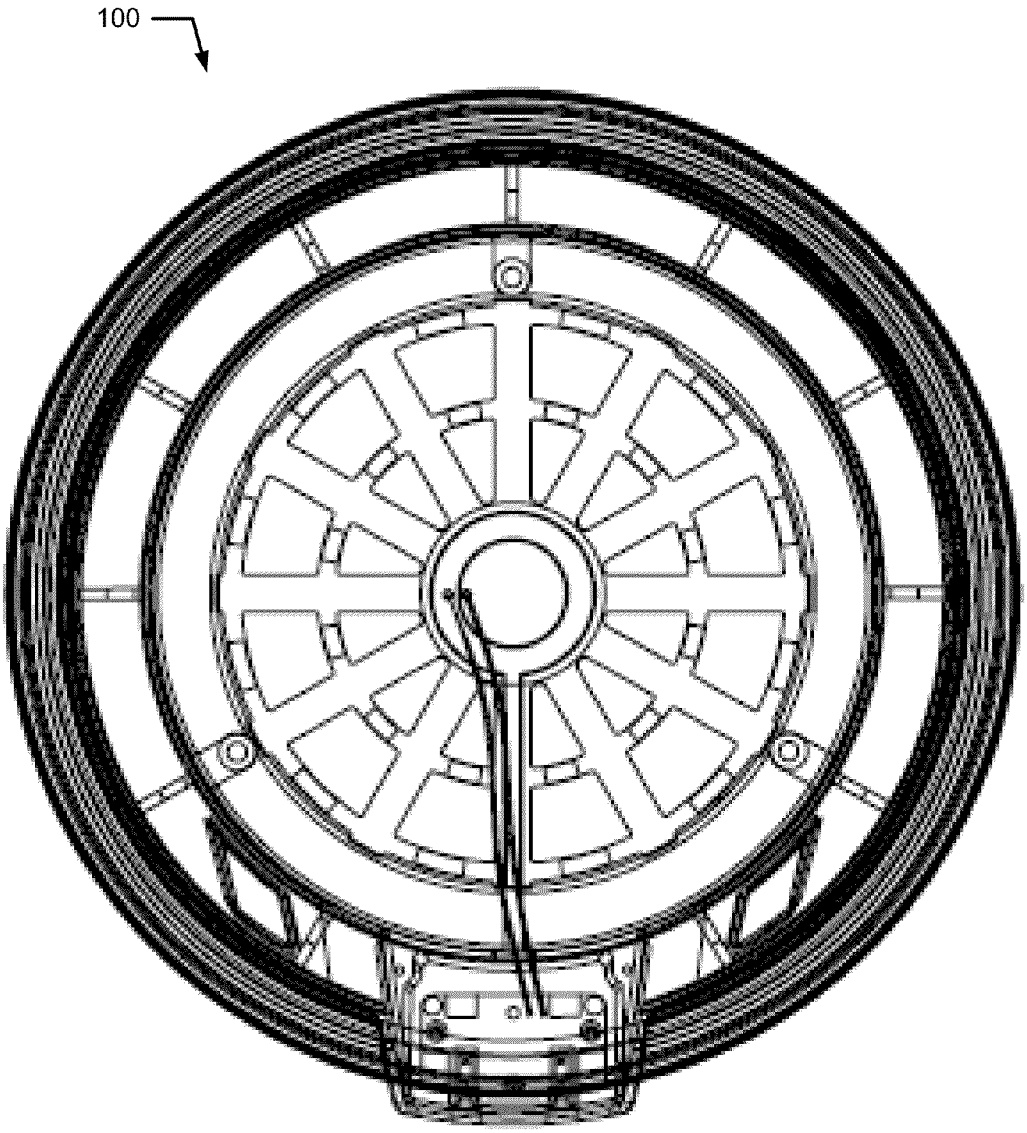
FIG. 4 is a bottom view of an assembly of the electronic percussion instrument of FIG. 1.

The percussion member 110 is configured to generate vibrations when percussed. For instance, the percussion member 110 may be a metallic plate such as, for example, a steel plate (e.g., when the electronic percussion instrument 100 is an electronic cymbal). In some embodiments, when the electronic percussion instrument 100 is an electronic drum, as depicted in FIG. 1, the percussion member 110 may be a metallic plate such as, for example, a steel plate and further comprising a rubber pad 115. In such case the metallic plate may be disposed between the rubber pad 115 and the vibration resonance member 120.

The vibration resonance member 120 is configured to sense and resonate with the vibrations generated by the percussion member 110. As shown in FIG. 1, the vibration resonance member 120 has a spider web-like configuration or shape and comprises a hub portion (i.e., the central portion), a plurality of radial portions extending radially from the hub portion, and a plurality of spiral portions. More specifically, as shown in FIG. 1, each of the spiral portions of the vibration resonance member 120 is disposed between and connects respective two of the radial portions. Additionally, each of the radial portions of the vibration resonance member 120 is connected to a respective adjacent one of the radial portions by one or more of the spiral portions.

A profile of the vibration resonance member 120 may take on a variety of shapes. FIGS. 5-7 illustrate some of the examples and, therefore, it is appreciated that the scope of the present disclosure is not limited thereto. FIG. 5 illustrates an electronic percussion member 500 that comprises a percussion member 510, a vibration resonance member 520, a vibration damping member 530, and an electronic sound generation unit 540. As shown in FIG. 5, a profile of a primary surface of the vibration resonance member 520 that faces the percussion member 510 is generally polygonal-shaped. FIG. 6 illustrates an electronic percussion member 600 that comprises a percussion member 610, a vibration resonance member 620, a vibration damping member 630, and an electronic sound generation unit 640. As shown in FIG. 6, a profile of a primary surface of the vibration resonance member 620 that faces the percussion member 610 is generally fan-shaped.

FIG. 7 illustrates an electronic percussion member 700 that comprises a percussion member 710, a vibration resonance member 720, a vibration damping member 730, and an electronic sound generation unit 740. As shown in FIG. 7, a profile of a primary surface of the vibration resonance member 720 that faces the percussion member 710 is generally round-shaped.

In some embodiments, to maximize the range of detection, a contour of a primary surface of the vibration resonance member 110 that faces the percussion member 120 is shaped to approximately match a contour of a portion of a primary surface of the percussion member 110 that faces the vibration resonance member 120.

In some embodiments, the vibration resonance member 120 comprises a plastic material. Alternatively, in some other embodiments, the vibration resonance member 120 comprises a metallic material.

The vibration damping member 130 is disposed between the percussion member 110 and the vibration resonance member 120, and is configured to propagate the vibrations generated by the percussion member 110 to the vibration resonance member 120. In some embodiments, as shown in FIG. 1, the vibration damping member 130 comprises a plurality of damping pads made of a soft material that are disposed between the percussion member 110 and the spiral portions of the vibration resonance member 120. In some other embodiments, the vibration damping member 130 may comprise a plurality of damping pads made of a soft material that are disposed between the percussion member 110 and the radial portions of the vibration resonance member 120. Alternatively, the vibration damping member 130 may comprise a plurality of damping pads made of a soft material that are disposed between the percussion member 110 and some or all of the radial portions as well as some or all of the spiral portions of the vibration resonance member 120.

In some embodiments, the vibration damping member 130 comprises a foam material. Alternatively, in some other embodiments, the vibration damping member 130 comprises a silicon-based material. In some embodiments, a thickness of the vibration resonance member 130 is between 0.3 mm and 5.0 mm approximately.

The electronic sound generation unit 140 is connected to the vibration resonance member 120 and is configured to sense the vibrations through the vibration resonance member 120 and output an electronic signal that is used in the generation of an electronic percussion sound. In some embodiments, the electronic sound generation unit 140 comprises a sensor such as, for example, a piezoelectric sensor. In some embodiments, the electronic sound generation unit 140 comprises the sensor and a circuit 145 that is coupled to the sensor to generate a signal that causes one or more speakers to output the electronic percussion sound.

In some embodiments, the sensor of the electronic sound generation unit 140 is at least partially disposed on the hub portion of the vibration resonance member 120 and on a surface of the hub portion that faces the percussion member 110. For example, the sensor may be disposed on the vibration resonance member 120 and between the percussion member 110 and the vibration resonance member 120, as shown in FIGS. 5-7. In some other embodiments, the sensor of the electronic sound generation unit 140 is at least partially disposed on the hub portion of the vibration resonance member 120 and on a surface of the hub portion that faces away from the percussion member 110. For example, the sensor may be disposed on the vibration resonance member 120 but not between the percussion member 110 and the vibration resonance member 120, as shown in FIGS. 1-4.

In some embodiments, as shown in FIG. 1, the electronic percussion instrument 100 further comprises a hoop 150 and a holder 160 such that the percussion member 110, the vibration resonance member 120, the vibration damping member 130, and at least a portion of the electronic sound generation unit 140 are disposed between the hoop 150 and the holder 160. The hoop 150 may be, for example, a rubber hoop made of rubber. The holder 160 may be, for example, a plastic holder made of plastic.

Figure 8:
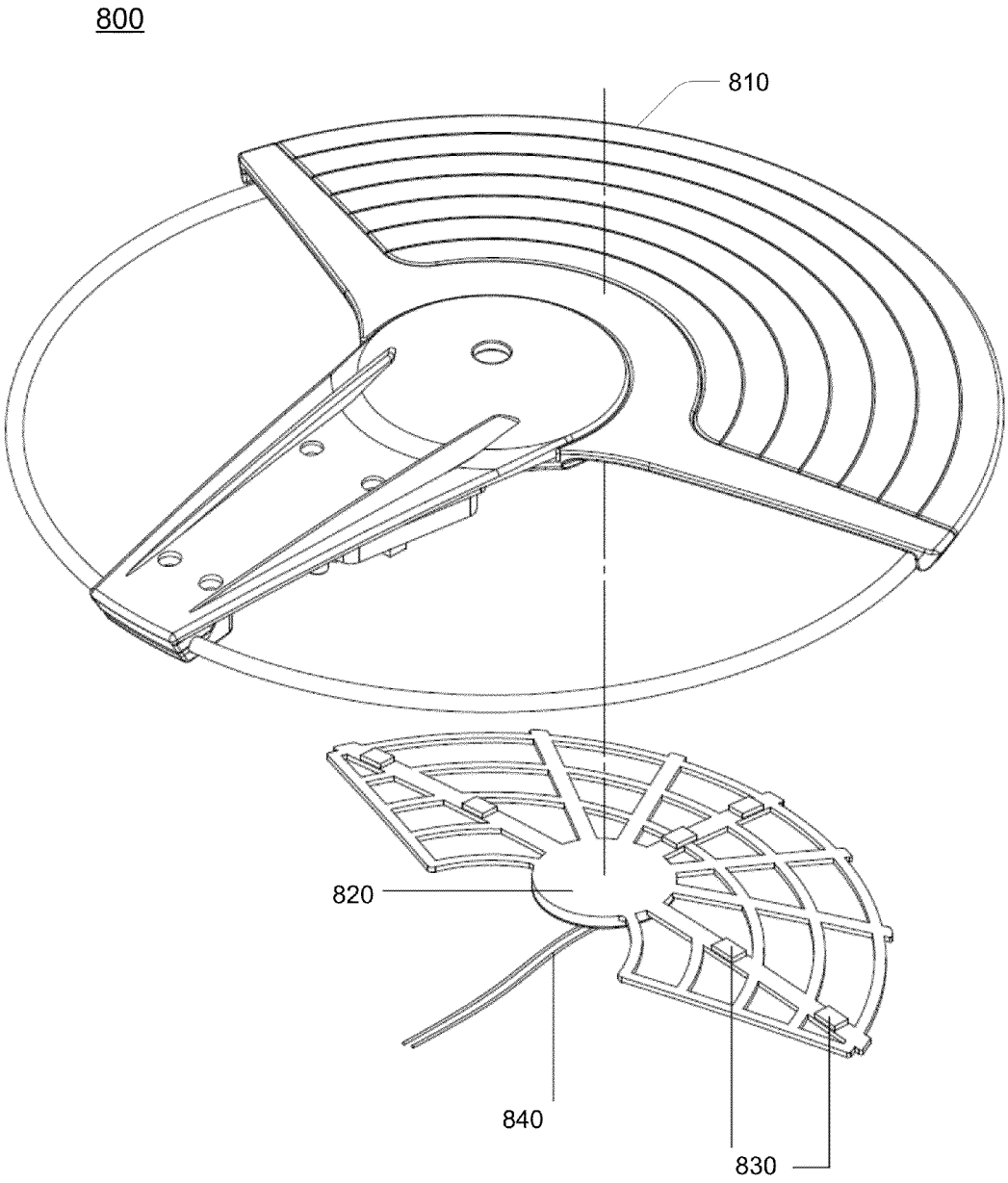
FIG. 8 is an exploded view of an assembly of an electronic percussion instrument in accordance with another embodiment of the present disclosure.
Figure 9:
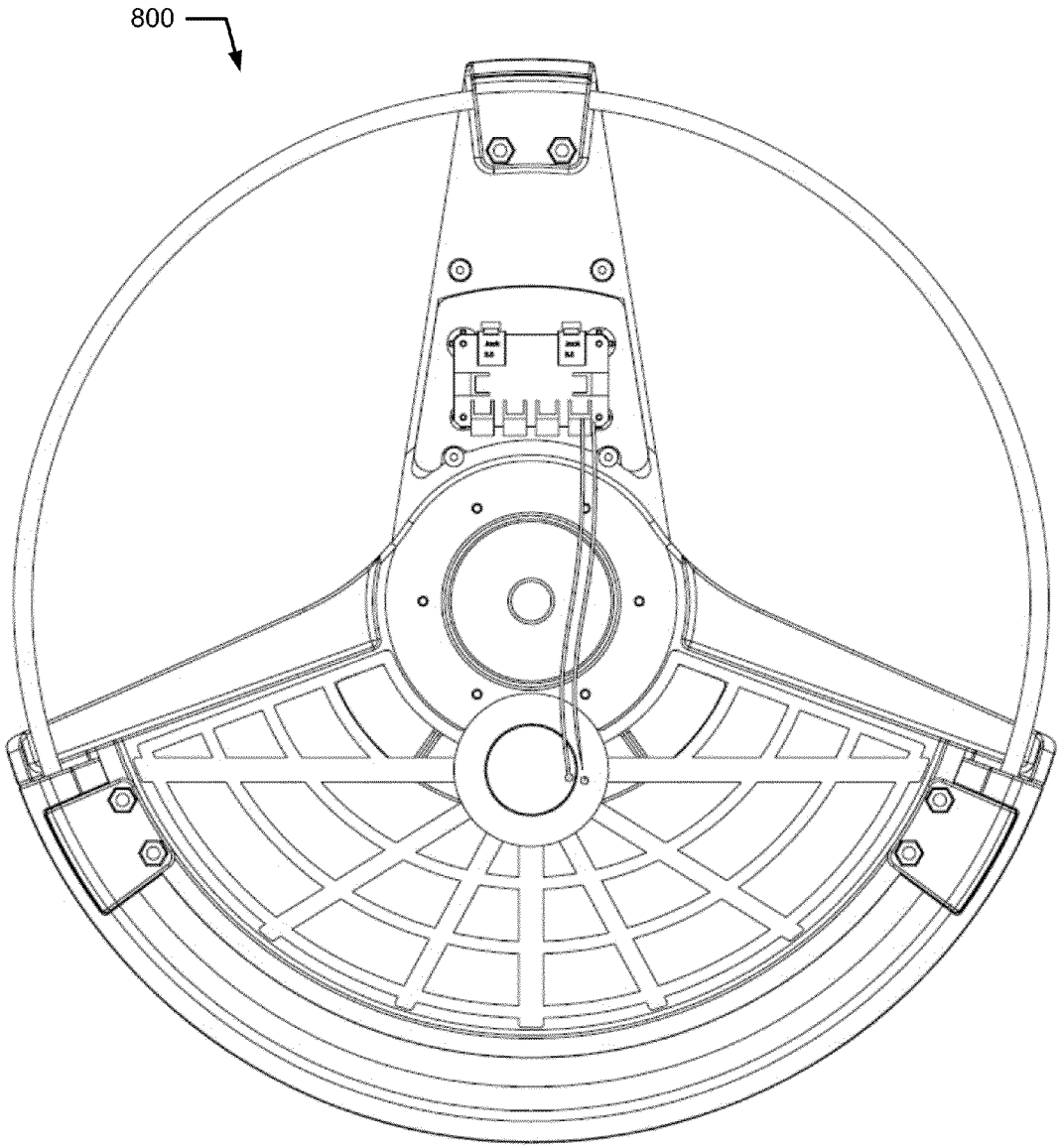
FIG. 9 is a bottom view of an assembly of the electronic percussion instrument of FIG. 8.

FIGS. 8-9 illustrate various views of an electronic percussion instrument 800 in accordance with another embodiment of the present disclosure. As shown in FIGS. 8-9, the electronic percussion instrument 800 comprises a percussion member 810, a vibration resonance member 820, a vibration damping member 830, and an electronic sound generation unit 840.

The percussion member 810 is configured to generate vibrations when percussed. For instance, the percussion member 810 may be a metallic plate such as, for example, a steel plate (e.g., when the electronic percussion instrument 800 is an electronic cymbal).

The vibration resonance member 820 is configured to sense and resonate with the vibrations generated by the percussion member 810. As shown in FIG. 8, the vibration resonance member 820 has a partial spider web-like configuration or shape and comprises a hub portion (i.e., the central portion), a plurality of radial portions extending radially from the hub portion, and a plurality of spiral portions. More specifically, as shown in FIG. 8, each of the spiral portions of the vibration resonance member 820 is disposed between and connects respective two of the radial portions. Additionally, each of the radial portions of the vibration resonance member 820 is connected to a respective adjacent one of the radial portions by one or more of the spiral portions.

A profile of the vibration resonance member 820 may take on a variety of shapes, such as those shown in FIGS. 5-8. In the interest of brevity, detailed description of FIGS. 5-7 will not be repeated.

In some embodiments, to maximize the range of detection, a contour of a primary surface of the vibration resonance member 810 that faces the percussion member 820 is shaped to approximately match a contour of a portion of a primary surface of the percussion member 810 that faces the vibration resonance member 820.

In some embodiments, the vibration resonance member 1820 comprises a plastic material. Alternatively, in some other embodiments, the vibration resonance member 820 comprises a metallic material.

The vibration damping member 830 is disposed between the percussion member 810 and the vibration resonance member 820, and is configured to propagate the vibrations generated by the percussion member 810 to the vibration resonance member 820. In some embodiments, as shown in FIG. 8, the vibration damping member 830 comprises a plurality of damping pads made of a soft material that are disposed between the percussion member 810 and the spiral portions of the vibration resonance member 820. In some other embodiments, the vibration damping member 830 may comprise a plurality of damping pads made of a soft material that are disposed between the percussion member 810 and the radial portions of the vibration resonance member 820. Alternatively, the vibration damping member 830 may comprise a plurality of damping pads made of a soft material that are disposed between the percussion member 810 and some or all of the radial portions as well as some or all of the spiral portions of the vibration resonance member 820.

In some embodiments, the vibration damping member 830 comprises a foam material. Alternatively, in some other embodiments, the vibration damping member 830 comprises a silicon-based material. In some embodiments, a thickness of the vibration resonance member 830 is between 0.3 mm and 5.0 mm approximately.

The electronic sound generation unit 840 is connected to the vibration resonance member 820 and is configured to sense the vibrations through the vibration resonance member 820 and output an electronic signal that is used in the generation of an electronic percussion sound. In some embodiments, the electronic sound generation unit 840 comprises a sensor such as, for example, a piezoelectric sensor. In some embodiments, the electronic sound generation unit 840 comprises the sensor and a circuit 845 that is coupled to the sensor to generate a signal that causes one or more speakers to output the electronic percussion sound.

In some embodiments, the sensor of the electronic sound generation unit 840 is at least partially disposed on the hub portion of the vibration resonance member 820 and on a surface of the hub portion that faces the percussion member 810. For example, the sensor may be disposed on the vibration resonance member 820 and between the percussion member 810 and the vibration resonance member 8208. In some other embodiments, the sensor of the electronic sound generation unit 840 is at least partially disposed on the hub portion of the vibration resonance member 820 and on a surface of the hub portion that faces away from the percussion member 810. For example, the sensor may be disposed on the vibration resonance member 820 but not between the percussion member 810 and the vibration resonance member 820, as shown in FIG. 8.

Figure 10:
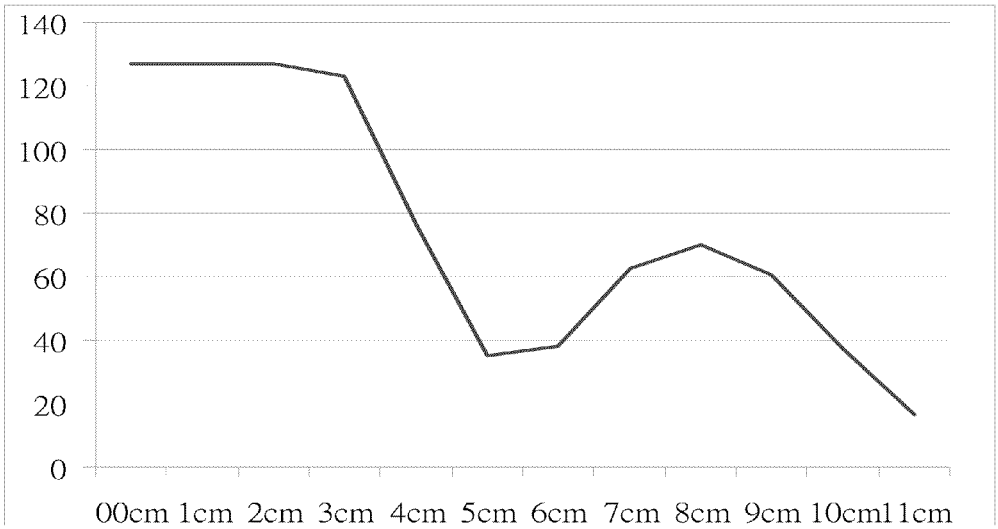
FIG. 10 is a graph of signal sensitivity versus radius of a percussion area in a conventional electronic percussion instrument.
Figure 11:
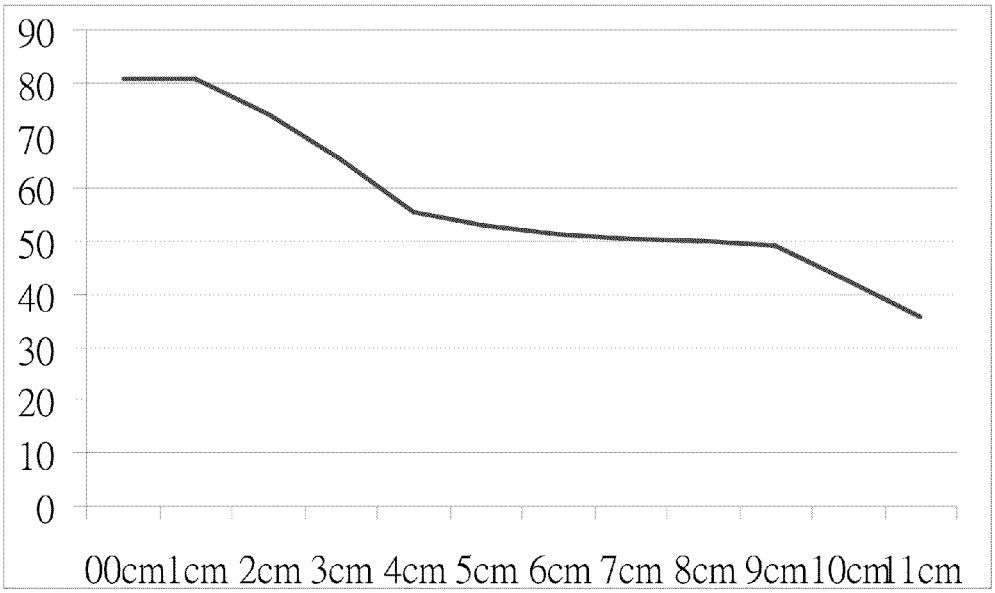
FIG. 11 is a graph of signal sensitivity versus radius of a percussion area in an electronic percussion instrument in accordance with an embodiment of the present disclosure.
Figure 12:
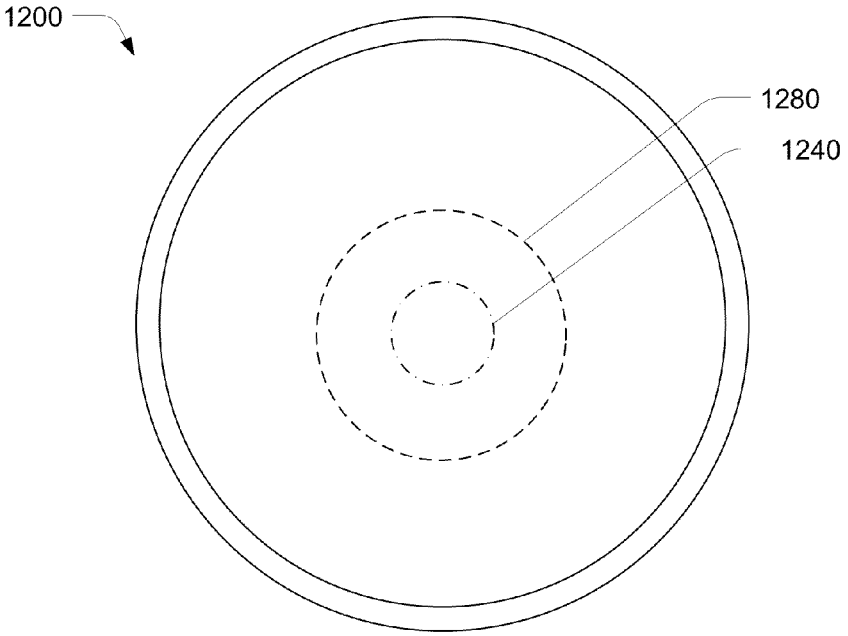
FIGURE 12 (PRIOR ART)
FIG. 12 is a top view of a conventional electronic drum.
Figure 13:
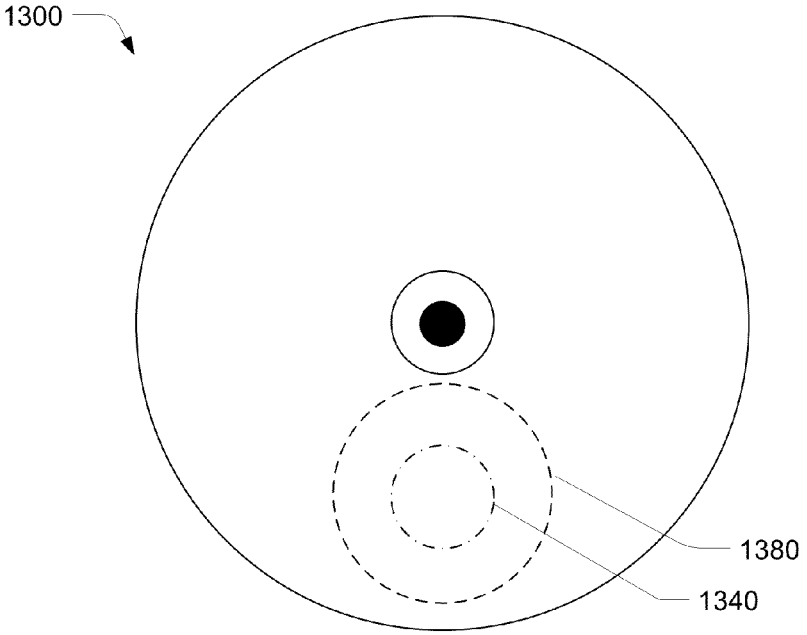
FIGURE 13 (PRIOR ART)
FIG. 13 is a top view of a conventional electronic cymbal.

FIG. 10 is a graph of signal sensitivity versus radius of a percussion area in a conventional electronic percussion instrument. FIG. 11 is a graph of signal sensitivity versus radius of a percussion area in an electronic percussion instrument in accordance with an embodiment of the present disclosure. The horizontal axis of each of the graphs in FIGS. 10 and 11 represents the radius of the percussion member 110 or 810, measured from the center (i.e., 0 cm) to the rim of the percussion member 110 or 810. The vertical axis of each of the graphs in FIGS. 10 and 11 represents the signal strength of the signal sensed by the sensor of the electronic sound generation unit 140 or 840. As shown in FIG. 10, the signal strength in a conventional electronic percussion instrument not using the spider web-like vibration resonance member of the present disclosure is relatively unstable, as the signal strength appears to be strong near the center and the rim of the percussion member but weak anywhere between the center and the rim of the percussion member. In contrast, the signal strength in an electronic percussion instrument of the present disclosure is relatively stable and more linear (stronger towards the center and weaker towards the rim of the percussion member 110 or 810).

Additional and Alternative Implementation Notes

The above-described techniques, devices and apparatuses pertain to electronic percussion instruments, such as electronic drums and electronic cymbals, with a spider web-like sensor. Although the techniques have been described in language specific to certain applications, it is to be understood that the appended claims are not necessarily limited to the specific features or applications described herein. Rather, the specific features and applications are disclosed as exemplary forms of implementing such techniques.

In the above description of exemplary implementations, for purposes of explanation, specific numbers, materials configurations, and other details are set forth in order to better explain the invention, as claimed. However, it will be apparent to one skilled in the art that the claimed invention may be practiced using different details than the exemplary ones described herein. In other instances, well-known features are omitted or simplified to clarify the description of the exemplary implementations.

The inventors intend the described exemplary implementations to be primarily examples. The inventors do not intend these exemplary implementations to limit the scope of the appended claims. Rather, the inventors have contemplated that the claimed invention might also be embodied and implemented in other ways, in conjunction with other present or future technologies.

Moreover, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts and techniques in a concrete fashion. The term "techniques," for instance, may refer to one or more devices, apparatuses, systems, methods, articles of manufacture, and/or computer-readable instructions as indicated by the context described herein.

As used in this application, the term "or" is intended to mean an inclusive "or" rather than an exclusive "or." That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more," unless specified otherwise or clear from context to be directed to a singular form.

For the purposes of this disclosure and the claims that follow, the terms "coupled" and "connected" may have been used to describe how various elements interface. Such described interfacing of various elements may be either direct or indirect.

What is claimed is:

1. An electronic percussion instrument, comprising:

a percussion member that generates vibrations when percussed;

a vibration resonance member that resonates with the vibrations, the vibration resonance member comprising a hub portion, a plurality of radial portions extending radially from the hub portion, and a plurality of spiral portions, wherein:

each of the spiral portions is disposed between and connects respective two of the radial portions, and each of the radial portions is connected to a respective adjacent one of the radial portions by one or more of the spiral portions;

a vibration damping member, disposed between and in direct contact with the percussion member and the vibration resonance member, that propagates the vibrations generated by the percussion member to the vibration resonance member; and an electronic sound generation unit, connected to the vibration resonance member, that senses the vibrations of the percussion member through the vibration damping member and the vibration resonance member and outputs a signal used in generation of an electronic percussion sound.

2. The electronic percussion instrument of claim 1, wherein a shape of the vibration resonance member generally resembles a spider web.

3. The electronic percussion instrument of claim 1, wherein a profile of a primary surface of the vibration resonance member that faces the percussion member is generally polygonal-shaped.

4. The electronic percussion instrument of claim 1, wherein a profile of a primary surface of the vibration resonance member that faces the percussion member is generally fan-shaped.

5. The electronic percussion instrument of claim 1, wherein a profile of a primary surface of the vibration resonance member that faces the percussion member is generally round-shaped.

6. The electronic percussion instrument of claim 1, wherein a thickness of the vibration resonance member is between 0.3 mm and 5.0 mm approximately.

7. The electronic percussion instrument of claim 1, wherein a contour of a primary surface of the vibration resonance member that faces the percussion member is shaped to approximately match a contour of a portion of a primary surface of the percussion member that faces the vibration resonance member.

8. The electronic percussion instrument of claim 1, wherein the vibration resonance member comprises a plastic material.

9. The electronic percussion instrument of claim 1, wherein the vibration resonance member comprises a metallic material.

10. The electronic percussion instrument of claim 1, wherein the vibration damping member comprises a plurality of damping pads, and wherein at least some of the damping pads are disposed between the percussion member and at least some of the spiral portions of the vibration resonance member.

11. The electronic percussion instrument of claim 1, wherein the vibration damping member comprises a plurality of damping pads, and wherein at least some of the damping pads are disposed between the percussion member and at least some of the radial portions of the vibration resonance member.

12. The electronic percussion instrument of claim 1, wherein the vibration damping member comprises a foam material.

13. The electronic percussion instrument of claim 1, wherein the vibration damping member comprises a silicon-based material.

14. The electronic percussion instrument of claim 1, wherein the electronic sound generation unit comprises:

a sensor that senses the vibrations and generates an electronic signal based on the vibrations; and a circuit, coupled to the sensor, that receives the electronic signal and generates the electronic percussion sound.

15. The electronic percussion instrument of claim 14, wherein the sensor comprises a piezoelectric sensor.

16. The electronic percussion instrument of claim 14, wherein the sensor is at least partially disposed on the hub portion of the vibration resonance member and on a surface of the hub portion that faces the percussion member.

17. The electronic percussion instrument of claim 14, wherein the sensor is at least partially disposed on the hub portion of the vibration resonance member and on a surface of the hub portion that faces away from the percussion member.

18. The electronic percussion instrument of claim 1, wherein the percussion member comprises a metallic plate.

19. The electronic percussion instrument of claim 18, wherein the percussion member further comprises a rubber pad, and wherein the metallic plate is disposed between the rubber pad and the vibration resonance member.

20. The electronic percussion instrument of claim 1, further comprising:

a hoop; and a holder, wherein the percussion member, the vibration resonance member, the vibration damping member, and at least a portion of the electronic sound generation unit are disposed between the hoop and the holder.

* * * * *